US011105320B2

(12) United States Patent
Bidell et al.

(10) Patent No.: US 11,105,320 B2
(45) Date of Patent: Aug. 31, 2021

(54) CONTROL PLATE FOR AXIAL PISTON MACHINE AND AXIAL PISTON MACHINE HAVING A CONTROL PLATE

(71) Applicant: Robert Bosch GmbH, Stuttgart (DE)

(72) Inventors: Alexander Bidell, Waldstetten (DE); Christian Hoermann, Weissenhorn (DE); Marcus Herrmann, Elchingen (DE); Raimund Roth, Nersingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/548,386

(22) Filed: Aug. 22, 2019

(65) Prior Publication Data

US 2020/0063724 A1 Feb. 27, 2020

(30) Foreign Application Priority Data

Aug. 22, 2018 (DE) ..... 10 2018 214 165.7

(51) Int. Cl.
*F04B 1/328* (2020.01)
*F04B 1/2092* (2020.01)
*F04B 1/146* (2020.01)

(52) U.S. Cl.
CPC ..... *F04B 1/328* (2013.01); *F04B 1/146* (2013.01); *F04B 1/2092* (2013.01)

(58) Field of Classification Search
CPC ..... F04B 1/146; F04B 1/328; F04B 1/2092; F04B 1/188; F01B 3/0055
USPC ..... 92/13.6
See application file for complete search history.

(56) References Cited

U.S. PATENT DOCUMENTS

| | | | |
|---|---|---|---|
| 3,924,515 | A | 12/1975 | Clerk |
| 2005/0238517 | A1 | 10/2005 | Gray, Jr. |

FOREIGN PATENT DOCUMENTS

| | | | |
|---|---|---|---|
| DE | 21 64 364 | | 6/1973 |
| DE | 29 08 119 | A1 | 9/1980 |
| DE | 10 2016 213 349 | A1 | 1/2018 |
| EP | 1 008 748 | A2 | 6/2000 |
| EP | 1 041 279 | A2 | 10/2000 |
| FR | 2 991 400 | A1 | 12/2013 |
| WO | 2012/014128 | A1 | 2/2012 |

OTHER PUBLICATIONS

German Search Report corresponding to German Application No. 10 2018 214 165.7, dated Mar. 29, 2019 (9 pages).

*Primary Examiner* — Abiy Teka
*Assistant Examiner* — Daniel S Collins
(74) *Attorney, Agent, or Firm* — Maginot, Moore & Beck LLP

(57) ABSTRACT

A control plate, for alternatingly fluidically connecting hydrostatic operating chambers, in particular of an oblique axis type axial piston machine, with pressure medium connections, includes a first end face, a second end face, at least a first recess, a first kidney-like control opening, and at least one through-recess. The first face extends transversely to a rotation axis. The second face faces away from the first face. The first recess is bounded in the first end face by the first control opening, and at least partially forms the at least one through recess, which extends toward the second end face from the first end face at an end portion of the first control opening, and which is arranged in or counter to a rotation direction of the rotation axis. An oblique axis construction type axial piston machine includes such a control plate.

20 Claims, 6 Drawing Sheets

CONTROL PLATE FOR AXIAL PISTON MACHINE AND AXIAL PISTON MACHINE HAVING A CONTROL PLATE

This application claims priority under 35 U.S.C. § 119 to patent application no. DE 10 2018 214 165.7, filed on Aug. 22, 2018 in Germany, the disclosure of which is incorporated herein by reference in its entirety.

The disclosure relates to a control plate, and an axial piston machine having the control plate.

BACKGROUND

The publications EP1008748 B1 and EP1041279 B1 set out axial piston machines of an oblique axis construction type with an adjustable displacement volume. In this instance, a pivotable control plate is provided in order to alternately connect in terms of pressure medium hydrostatic operating chambers of a cylinder drum of the machine to the pressure medium connections thereof. Through-recesses extend through the control plate and are fixedly associated with one of the pressure connections of the axial piston machine individually or in groups. At the side of the cylinder drum, the through-recesses extend from the parallel with the rotation axis of the cylinder drum. The inner wall portions of the through-recesses are therefore formed in a substantially cylindrical manner.

During operation, that is to say, with a rotating cylinder drum, operating chamber openings pass over the control openings of the through-recesses and there is produced at the operating chambers alternately the pressure change and the discharge and intake of pressure medium, sometimes at high flow speeds. In this case, occurrences of turbulence which can lead to pressure loss and in an unfavorable case to cavitation may occur.

Fundamentally, there is always in this area of high dynamics the requirement to increase the efficiency of the pressure change and therefore the efficiency of the machine.

SUMMARY

In this regard, an object of the disclosure is to provide a control plate with a lower level of turbulence and optimized flow. Another object is to provide an axial piston machine with lower flow losses.

The first object is achieved by a control plate having features according to the disclosure and the second object is achieved by an axial piston machine having features according to the disclosure.

Advantageous developments of the control plate and the axial piston machine are described in the detailed description, drawings, and claims.

A control plate, in particular control lens, for alternately connecting in terms of pressure medium hydrostatic operating chambers of an axial piston machine which is in particular constructed as the oblique axis construction type to the pressure medium connections thereof has a first end face which extends transversely to a rotation axis, in particular a sliding face, which is provided in particular for slidable abutment with an end face of a cylinder drum of the axial piston machine which can be rotated about the rotation axis. Furthermore, it has a second end face, in particular a sliding face, which is directed away from the first end face and which is provided in particular for fixed or slidable abutment with a connection portion of the axial piston machine. In this case, at least a first recess in the control plate which is bounded in the first end face by a first kidney-like control opening and by which at least one through-recess toward the second end face is at least partially formed extends from the first end face in the direction toward the second end face. In this case, the first recess has a first wall portion at an end portion of the kidney-like control opening arranged in or counter to a rotation direction. According to the disclosure the first wall portion extends so as to be at least partially positioned relative to the rotation axis.

In this manner, the end portion of the control opening and of the first recess which is subjected to particularly high flow dynamics in the event of a pressure change has an improved flow behavior and lower occurrences of turbulence, whereby pressure loss at this location is reduced and the efficiency is increased.

For the purposes of centering the cylinder drum, the first end face is a part-face of a sphere, in particular a ball, wherein the rotation axis extends through poles of the sphere.

In a development, the first end face is rotationally symmetrical with respect to the rotation axis, with the possible exception of recesses.

In order to adjust the displacement volume, in one development a pivot axis about which the control plate can be pivoted is provided.

The pivot axis preferably extends normally relative to the rotation axis. In particular, the two axes intersect.

In a development, the second end face is a part-face of a circular cylinder or it is composed of part-faces of a plurality of circular cylinders, the longitudinal axis of which is the pivot axis.

The second end face may have a constant cross-section.

For pivoting, the cross-section thereof is preferably curved in a convex manner and extends partially around the pivot axis.

In a development, the control plate has an in particular circular-cylindrical bearing hole, in particular a through-hole, which is in particular concentric with respect to the rotation axis. In particular, the bearing hole is provided to receive a journal, via which an actuation force can be transmitted for pivoting.

In a development, the kidney-like first control opening extends at both sides of a pitch circle portion, the circle center of which coincides with the rotation axis.

In a development, the kidney-like control opening has at the end portion, at which the first wall portion is arranged, a circle-portion-like edge, the circle center of which is located on the pitch circle portion.

In order to keep occurrences of turbulence and pressure loss low, the first wall portion is constructed in a development at least partially so as to be constant in terms of tangent, in particular constant in terms of curvature.

Cross-sections of the first wall portion may be arranged in planes, the normal of which is the rotation axis.

The cross-sections may be oval portions or in particular circle portions with identical radii. Alternatively, they may have different radii. In this case, the radius preferably changes constantly.

The total of the circle centers of the cross-sections may form a curve which is in particular constant in terms of tangent or in terms of curvature. In this case, a tangent of the curve is at least in locations skew relative to the rotation axis. The curve may be a 3D curve, a curve which is arranged in a plane or a straight line.

In a preferred flow-optimized development, a second recess which is associated with the at least one first recess extends from the second end face in the direction toward the first end face. This recess is preferably bounded by a second slot-like control opening which is formed in the second end face. Preferably, the through-recess is at least partially formed by the second recess, in particular together with the first recess. In this case, a second recess which is formed accordingly is preferably associated with each first recess. The second recess extends in particular transversely relative to the pivot axis so that the pressure medium connection is ensured for all the pivot angles.

In a development, the constant curve extends so obliquely relative to the rotation axis that the first wall portion extends as far as the associated second recess.

In a development wherein the first wall portion tapers from the first end face in the direction of the second end face constantly and/or diameters of the cross-sections of the first wall portion decrease constantly from the first end face in the direction of the second end face. The tapering or decrease may occur linearly or degressively or progressively. Alternatively, the tapering or decrease may occur in the opposite direction.

In a preferred development, the at least one first recess forms an intersection with the second recess which is associated therewith. In particular, the two recesses are constructed to be sufficiently deep for this purpose.

In a development, the intersection may be constructed at least partially with sharp edges and/or in a rounded manner, in particular so as to be adapted to the operating or flow conditions. A face of the intersection may be constructed to be constant in terms of tangent, in particular constant in terms of curvature. Furthermore, it may adjoin at least one of the two recesses in a manner at least constant in terms of tangent, in particular constant in terms of curvature.

In a development, at least one of the kidney-like control openings has two end portions which are arranged in one of the rotation directions, respectively. A respective edge of the end portions which is projectable in a plane which is normal to the rotation axis is at least partially arranged between the rotation axis and an edge of the associated second recess, which edge is projectable into the plane and is arranged to be proximal relative to the rotation axis.

In a development, the first recess has a second wall portion which is bounded by the first kidney-like control opening, in particular over the entire extent.

In a development, the second wall portion extends at least partially parallel with the rotation axis or cylindrically along it. In this case, the first wall portion is connected or intersected by the second wall portion with sharp edges or in a rounded manner. In this case, a height or length of the second wall portion in the direction of the rotation axis is smaller by one or two orders of magnitude in a connection region with respect to the first wall portion than a diameter of the first kidney-like control opening in a radial direction relative to the rotation axis.

In a development, the second recess has, in the region of an end portion of the slot-like control opening which is arranged in particular in a pivot direction, a third wall portion which is constructed so as to be convex in a radial direction of a pivot axis of the control plate. The third wall portion preferably forms at least partially the intersection with the first wall portion. The third wall portion may extend at least partially parallel with the pivot axis. Alternatively or additionally, it may be in the form of a circular-cylindrical portion, wherein the cylinder axis is parallel with the rotation axis.

A preferred development has two first and two second control openings. Preferably, they are constructed and/or arranged symmetrically relative to a first plane of symmetry which is defined by the rotation axis and a vertex of a pitch circle arranged between the first control openings. In this case, however, in particular asymmetrically arranged and/or constructed control notches of the control openings may deviate from symmetry.

In a development, the control plate is symmetrical relative to a second plane of symmetry which is defined by the rotation axis and which is normal relative to the first plane of symmetry. In this instance, the already mentioned asymmetry of the control notches is also possible.

An axial piston machine of the oblique axis construction type has a control plate which is configured according to the disclosure. It further has a housing, which the control plate abuts with the second end face thereof, in the case of a constant displacement volume in a fixed manner and in the case of an adjustable displacement volume in a slidable manner. In this case, the housing or a portion thereof is passed through by at least one pressure medium duct starting from the through-recess of the control plate toward a pressure medium connection or a pressure medium connection receiving member. It preferably has a cast central portion.

In a development, the pressure medium duct has at least one end portion which is produced in a cutting manner and which is directed toward the through-recess or the pressure medium connection. Preferably, both end portions are produced in this manner.

In a development, the central portion extends so as to be positioned relative to a pivot plane or a center plane of the axial piston machine.

In order to optimize the flow in the pressure medium duct, in a development the central portion adjoins one of or both of the end portions of the pressure medium duct, relative to the center axis thereof, at least partially in a bulging manner so that the central portion is extended radially at that location with respect to the end portions.

The end portions of the pressure medium duct preferably extend along the center axis thereof with a constant, in particular circular cross-section.

In order to facilitate assembly, the housing is in several pieces. In this case, it has a separate connection plate which the control plate adjoins with the second end face thereof in a fixed or slidable manner. The connection plate is passed through by the pressure medium duct and carries the pressure medium connections or at least the receiving members thereof.

The center axis or center axes of the end portions of the pressure medium duct is/are preferably perpendicular to the pivot axis.

Such a pressure medium duct is preferably associated with every second control opening.

A blind hole preferably opens transversely in each pressure medium duct.

BRIEF DESCRIPTION OF THE DRAWINGS

One embodiment of an axial piston machine according to the disclosure and a control plate according to the disclosure are illustrated in the drawings. The disclosure will now be explained in greater detail with reference to the Figures of these drawings.

In the drawings.

DETAILED DESCRIPTION

Figure 1:
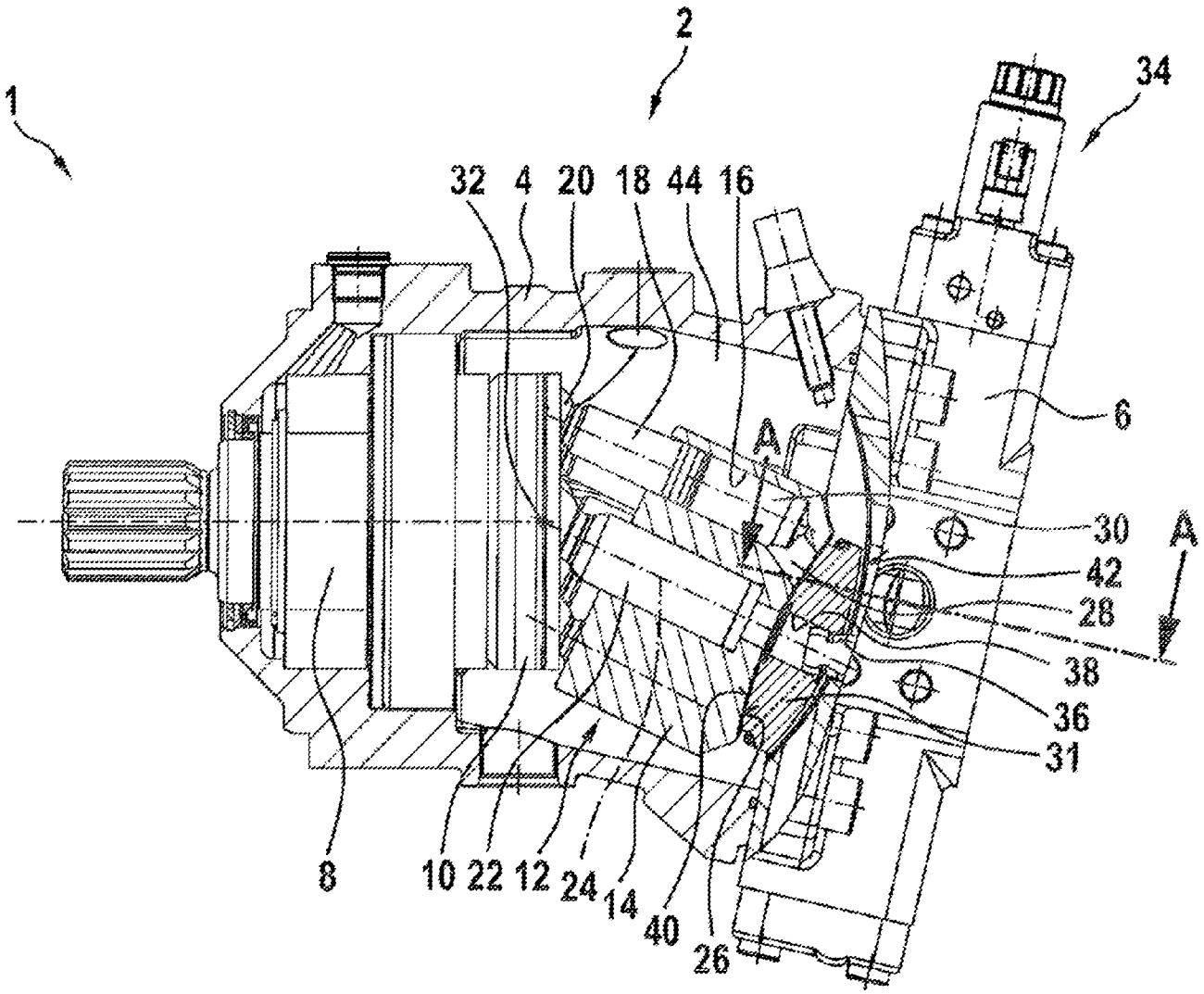
FIG. 1 is a longitudinal section taken in the pivot plane of an axial piston machine of the oblique axis construction type with a pivotable control plate and with a connection plate.

According to FIG. 1, an axial piston machine 1 which is of the oblique axis construction type and which is configured with an adjustable displacement volume has a housing 2 having a substantially pot-like housing portion 4 and a connection cover 6 for closing it. A drive shaft 8 is received in a rotatably supported manner in the housing portion 4. The drive shaft has a front-side drive shaft flange 10 which is connected in a rotationally secure manner to a drive mechanism 12 of the axial piston machine 1. The drive mechanism 12 has a cylinder drum 14 in which cylinder bores 16 which are open relative to the drive shaft flange 10 and which are arranged on a pitch circle are constructed. A hydrostatic operating piston 18 is received in the cylinder bores 16 for movement in translation. The piston heads 20 thereof are each pivotably received in an adapted, partially spherical recess (not illustrated) of the drive shaft flange 10. The cylinder drum 14 is supported in a manner rotatable about a rotation axis 24 via a central piston 22 which is received in a rotatable manner in a central cylinder bore of the cylinder drum 14 and for translational movement to a small extent. A spherical/concave end face 26 of the cylinder drum 14 directed away from the drive shaft flange 10 has operating chamber openings 28 of operating chambers 30 which are limited by the operating pistons 18 and the cylinder bores 16. In this case, the operating chamber openings 28 can be brought into alternating pressure medium connections with respect to pressure medium connections (not illustrated) of the connection plate 6 via a control plate 31 according to the disclosure and the through-recesses thereof (cf. FIG. 3 ff.).

The displacement volume of the axial piston machine 1 is adjustable, which is brought about by the pivotability of the cylinder drum 14 and the control plate 31 about a pivot axis 32. To this end, a hydrostatic adjustment device 34 is provided. A journal 36 which engages in a central through-hole or bearing hole 38 of the control plate 31 is articulated thereby.

The control plate 31 has a first spherical end face 40 which is adapted to the end face 26 of the cylinder drum 14. As a result of the spherical configuration of the two mentioned end faces, the cylinder drum 14 is centered on the control plate 31 with respect to the rotation axis 24 thereof. At the side of the connection plate 6, the control plate 31 has a substantially circular-cylindrical-portion-like second end face 42.

Figure 2:
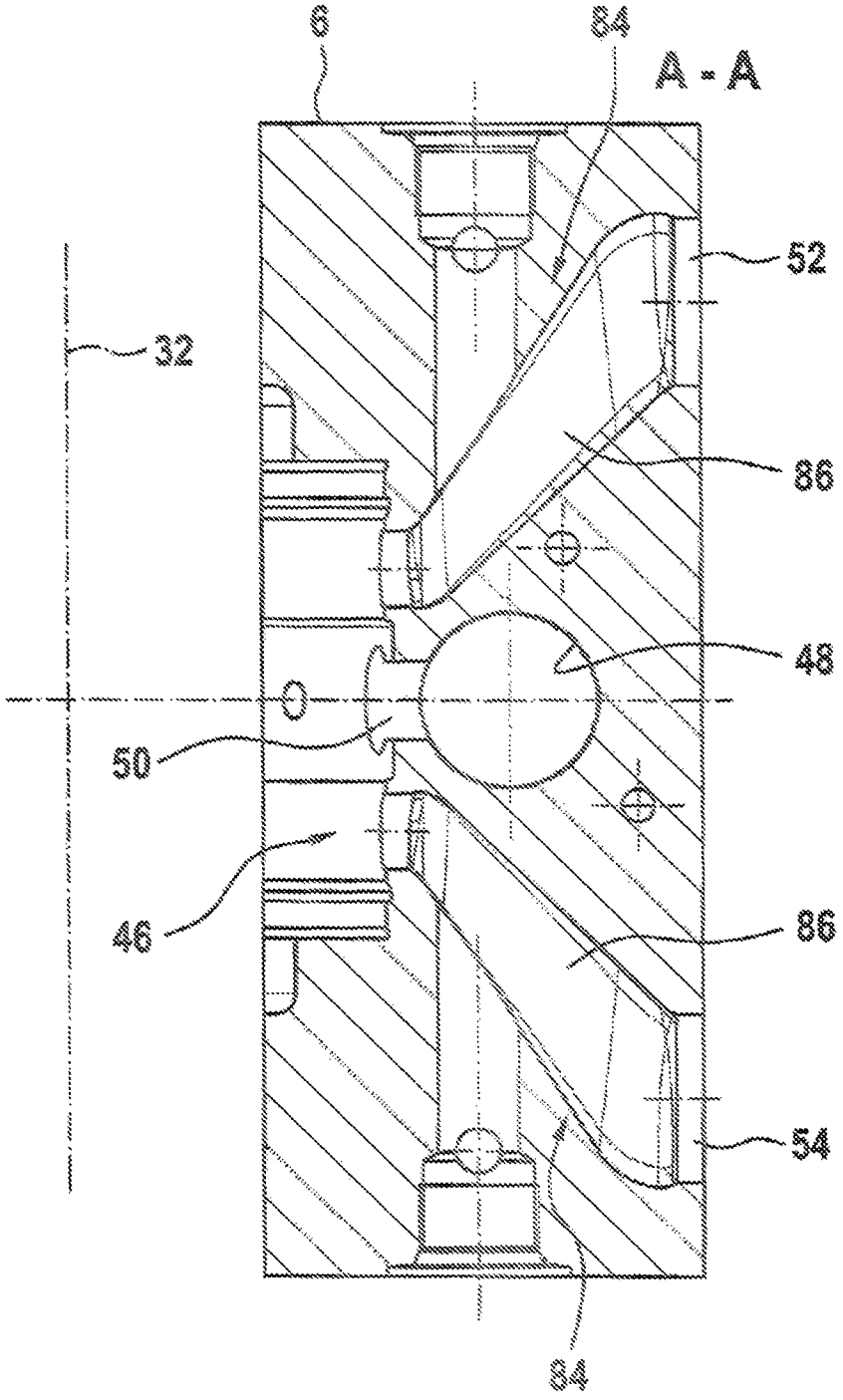
FIG. 2 shows the connection plate according to FIG. 1 in a cross-section which is defined by the pivot axis.

FIG. 2 shows the connection plate 6 as a cross-section A-A, as defined in FIG. 1. The connection plate 6 has a substantially rectangular cross-section and has at a side facing the inner housing space 44 according to FIG. 1 a substantially circular-cylindrical-portion-like pivot bearing receiving member 46 for receiving a sliding bearing. This bearing is in turn provided to receive the second end face 42 of the control plate 31 according to FIG. 1. The control plate 31 is pivotably supported in the pivot bearing about the pivot axis 32 according to FIG. 1. The connection plate 6 further has a cylinder bore 48, in which an actuating piston (not illustrated) of the adjustment device 34 according to FIG. 1 is guided in an axially displaceable manner. The actuating piston is connected to the journal 36 according to FIG. 1. The pivot bearing receiving member 46 has a slot-like access recess 50 which extends in the pivot direction for accessing the journal 36 from the cylinder bore 48 as far as a location in the through-hole 38 of the control plate 31. The connection plate 6 has at an outer side two pressure medium connection receiving members 52, 54 in which pressure medium connections can be inserted.

Before the additional configuration of the connection plate 6 according to FIG. 2 is discussed, the description of the control plate 31 according to the disclosure follows with reference to FIGS. 3 to 6.

Figure 3:
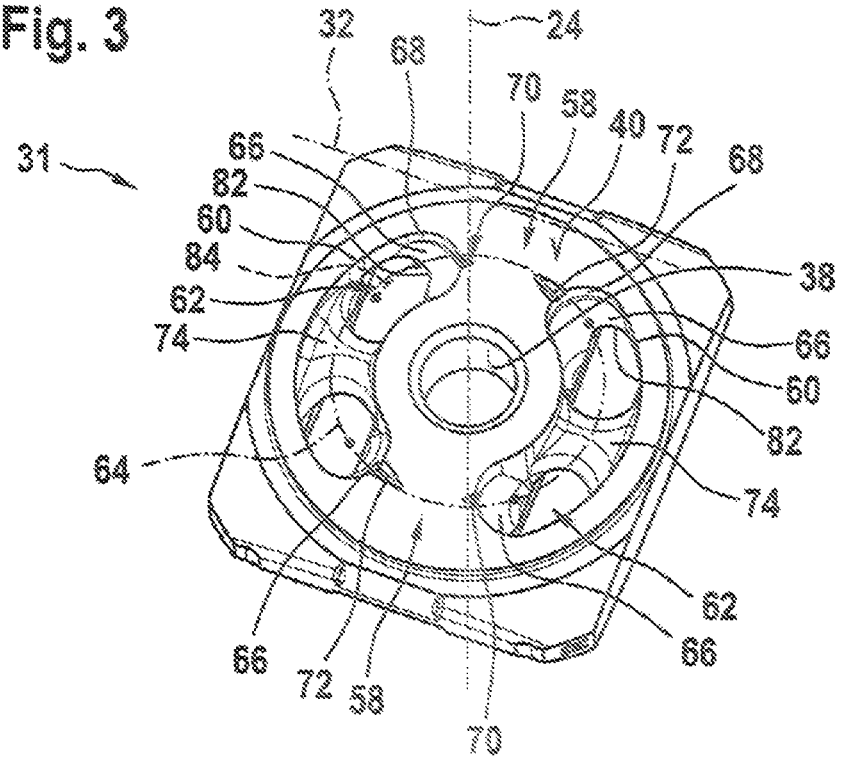
FIG. 3 is a perspective view of the control plate according to FIG. 1 when viewed toward a cylinder-drum-side end face.

The control plate 31 which is illustrated as a perspective view in FIG. 3 extends about a rotation axis 24 of the cylinder drum 14 as a center axis. It has the through-hole 38 concentrically relative to the rotation axis 24 for receiving the journal 36 according to FIG. 1. The control plate 31 has the first end face 40 which has a radially internally arranged and a radially externally arranged spherical ball portion. Both portions are connected by control faces 58. In this case, these faces separate two first kidney-like control openings 60 from each other in fluid terms. The first control openings 60 bound a first recess 62 which is constructed in the first end face 40. The control openings 60 and first recesses 62 extend equidistantly at both sides of a pitch circle 64 which is arranged concentrically relative to the rotation axis 24. Two through-recesses are partially constructed from the first recesses 62 toward the second end face. The first recesses 62 have at each of the end portions thereof arranged in a peripheral direction of the pitch circle 64 a first wall portion 66 which is positioned relative to the rotation axis 24 according to the disclosure.

In other words, tangential planes of the first wall portion 66 are positioned relative to the rotation axis 24.

In comparison with conventional wall portions of conventional first recesses which extend cylindrically or partially cylindrically from the first end face as far as the second end face at the other side, the first wall portion 66 which is positioned according to the disclosure allows a more favorable flow behavior in the sense of smaller occurrences of turbulence and pressure losses.

From the first end face 40 and the bounding or control opening 60 thereof, the first recess 62 extends with a second wall portion 68 which extends parallel with the rotation axis 24 and consequently cylindrically. The second wall portion 68 extends in this case completely circumferentially around the first control opening 60.

In order to minimize pressure peaks or pressure shocks during control, the control openings 60 have control notches 70, 72 in the region of vertex points of the end portions thereof relative to the rotation direction. In the embodiment shown according to FIG. 3, the control plate 31/the axial piston machine 1 has a preferred operating quadrant so that the control notches 70, 72 are configured in an asymmetrical manner.

The first recesses 62 are each subdivided into two part-recesses via a central web 74 which is recessed relative to the first end face 40 and the second end face.

Figure 4:
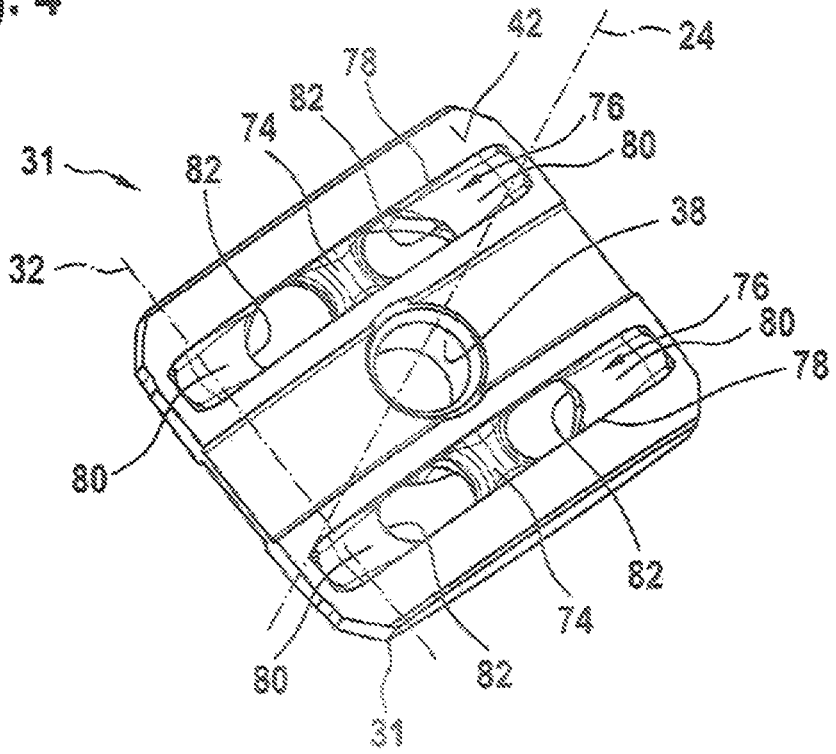
FIG. 4 is a perspective view of the control plate according to FIG. 1 and FIG. 3, when viewed toward an end face which faces the connection plate.
Figure 5:
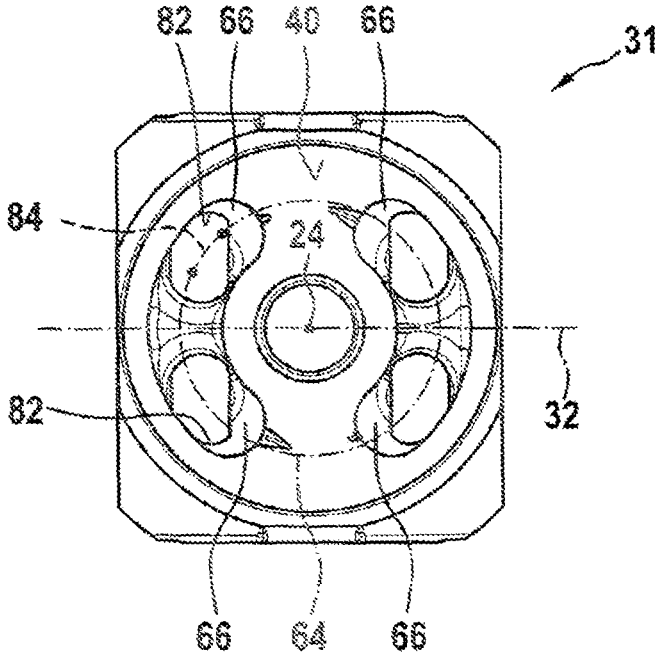
FIG. 5 is a plan view of the control plate according to FIG. 3.
Figure 6:
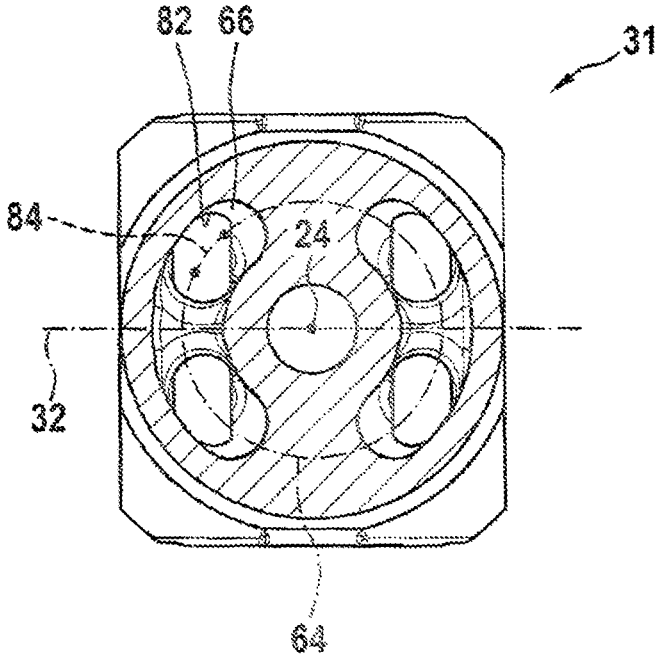
FIG. 6 is a cross-section of the control plate according to FIG. 5, taken perpendicularly to the rotation axis of the cylinder drum.
Figure 7A:
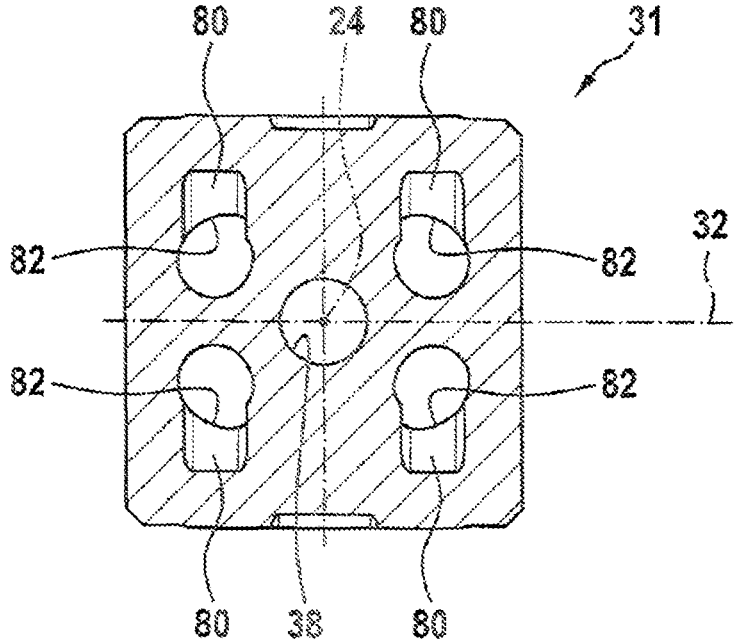
FIGS. 7*a* to 8*b* are cross-sections of the control plate in a manner normal to the rotation axis.
Figure 7B:
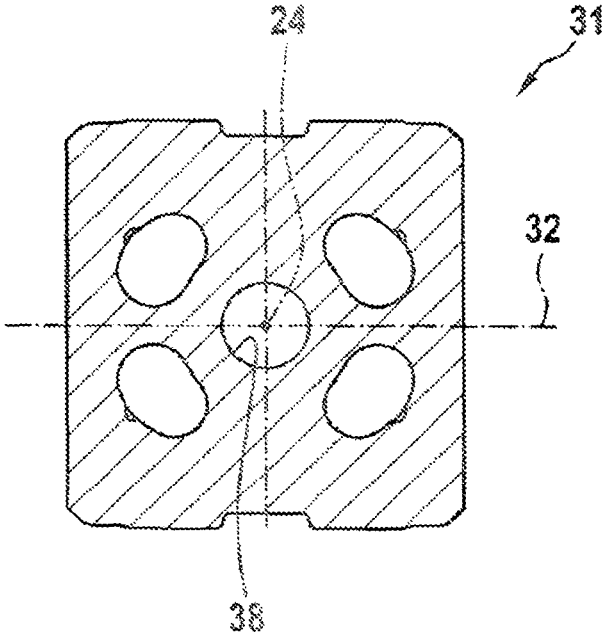
Figure 8A:
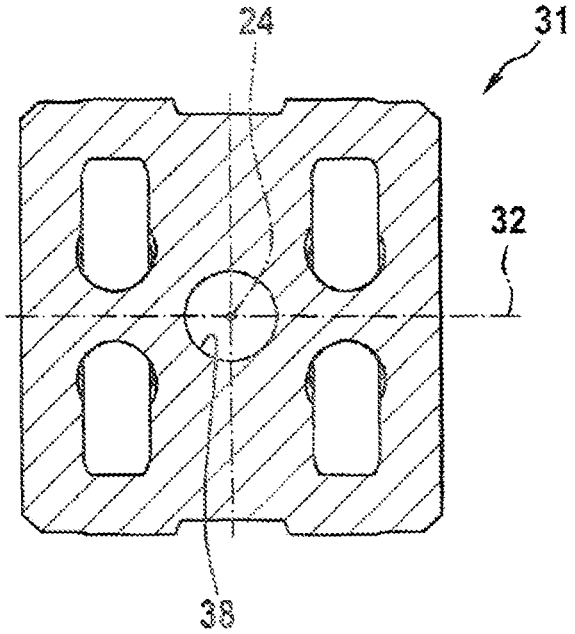
Figure 8B:
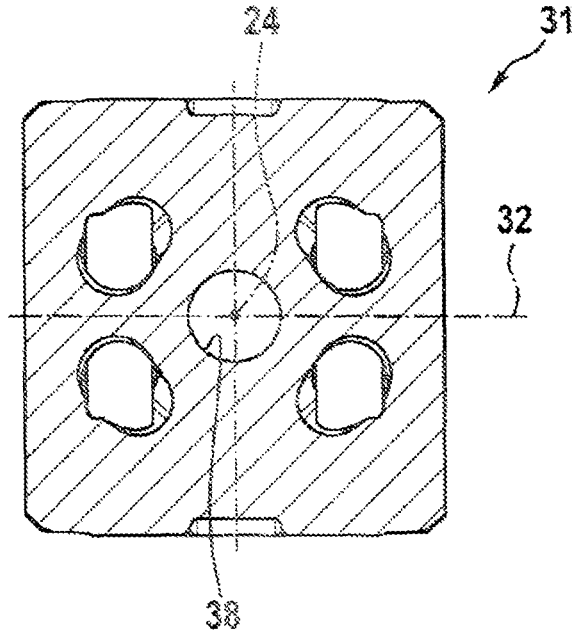

FIG. 4 shows the control plate 31 according to the preceding Figures as a perspective view when viewed toward the second end face 42. The end face 42 extends partially cylindrically about the pivot axis 32 and has a second recess 76 which extends transversely relative thereto, which are each bounded by a slot-like or longitudinal-groove-like second control opening 78.

In this case, one of the second recesses 76 is associated with each first recess 62.

The second recesses 76 are also subdivided via the central web 74 into two part-recesses. In this manner, the part-recesses of the first recesses 62 and second recesses 76 together form the respective through-recesses.

At each end portion of the second control opening 78 which is arranged in a pivot direction, the second recesses 76 each have a third wall portion 80 which, in a manner positioned relative to the rotation axis 24, falls away at a shallow angle relative to the second end face 42. The third wall portions 80 form with the first wall portions 66 according to FIG. 3 an intersection 82 which is sharp-edged in the embodiment shown.

With reference to FIG. 3, a constant curve 84 which is formed as follows is illustrated therein. Each first wall portion 66 has a pitch-circle-like or circle-portion-like cross-section in a plane perpendicular to the rotation axis 24. Circle centers of these cross-sections form the curve 84. The curve 84 can be projected onto the pitch circle 64 in the embodiment shown (cf. FIG. 5) and is positioned at a constant positioning angle relative to a plane of the pitch circle 64. In a different manner, however, linear progressions of the curve 84 or progressions with a variable curvature and variable positioning angle are also conceivable. Accordingly, a different shape of the first wall portion 66 is then produced. The first wall portion 66 can further be formed by other, for example, oval cross-sections in a manner different from circle-portion-like cross-sections.

According to the section A-A in FIG. 2, a pressure medium duct 84 extends from a base of the pivot bearing receiving member 46 at both sides of a center plane toward the respective pressure medium connection receiving member 52, 54. With respect to the center plane, the pressure medium ducts 84 extend in this direction mainly in a divergent manner or in a manner offset outward. Furthermore, a diameter of the pressure medium ducts 84 expands constantly in this direction. The respective pressure medium duct 84 has a central portion 86 which is produced by means of a cast core. End portions of the pressure medium ducts 84 opening in the pivot bearing receiving member 46 are formed in a cutting manner with circular-cylindrical inner walls. The same applies to the pressure medium connection receiving members 52, 54. The central portion 84 bulges out at the transition relative to the respective pressure medium connection receiving member 52, 54 relative to the center plane at least at the outer side so that it radially projects beyond the respective receiving member 52, 54. The same arrangement is provided at the transition to the respective opening into the pivot bearing receiving member 46 relative to the center plane at least at the inner side. Both bulging arrangements contribute to the improvement of the pressure medium flow.

FIGS. 7*a* to 8*b* show sections normal to the rotation axis 24 which illustrate the configuration of the first and second wall portions 66, 80 and the intersection 82.

There is disclosed a control plate for an axial piston machine, in particular of an oblique axis construction type. In this case, the control plate has at least one through-recess. This through-recess serves to connect in terms of pressure medium hydrostatic operating chambers of the axial piston machine which pass over them to a fixed pressure medium connection of the axial piston machine. In this case, at least one wall portion of the through-recess is positioned relative to the rotation axis in order to optimize the flow.

There is further disclosed an axial piston machine having such a control plate.

LIST OF REFERENCE NUMERALS

1 Axial piston machine
2 Housing
4 Housing portion
6 Connection plate
8 Drive shaft
10 Drive shaft flange
12 Drive mechanism
14 Cylinder drum
16 Cylinder bore
18 Operating piston
20 Ball head
22 Central piston
24 Rotation axis
26 End-face cylinder drum
28 Operating chamber opening
30 Operating chamber
31 Control plate
32 Pivot axis
34 Hydrostatic adjustment device
36 Journal
38 Through-hole
40 First end face
42 Second end face
44 Inner housing space
46 Pivot bearing receiving member
48 Cylinder bore
50 Access recess
52, 54 Pressure medium connection receiving member
58 Control region
60 First kidney-like control opening
62 First recess
64 Pitch circle
66 First wall portion
68 Second wall portion
70, 72 Control notch
74 Central web
76 Second recess
78 Second control opening
80 Third wall portion
82 Intersection
84 Pressure medium duct
86 Central portion

What is claimed is:

1. A control plate, the control plate configured to alternatingly connect hydrostatic operating chambers of an oblique axis construction type axial piston machine to pressure medium connections of the axial piston machine in terms of pressure medium, the control plate comprising:

a first end face extending transversely to a rotation axis, the first end face including:

a first kidney-like control opening; and a first recess bounded in the first end face by the first kidney-like control opening, the first recess having a first wall portion at an end portion of the first kidney-like control opening, the first wall portion arranged in or counter to a rotation direction around the rotation axis; and a second end face directed away from the first end face, wherein the first recess at least partially forms at least one through recess extending from the first end face toward the second end face, and the first wall portion has a curved end portion at a junction with the at least one through recess, wherein the curved end portion has a constant curvature.

2. The control plate of claim 1, wherein:

the second end face further includes a second recess associated with the first recess;

the second recess forms a first slot-like control opening in the second end face; and the at least one through recess is at least partially formed by the second recess so as to extend from the second end face in a direction toward the first end face.

3. The control plate of claim 2, wherein the second recess has, in a region of an end portion of the second slot-like control opening, a third wall portion arranged in a pivot direction, the third wall configured so as to be convex in a radial direction of a pivot axis of the control plate.

4. The control plate of claim 2, wherein the first recess and the second recess form an intersection.

5. The control plate of claim 4, wherein the intersection is configured, at least partially, so as to have a sharp edge portion.

6. The control plate of claim 1, wherein the first recess further has a second wall portion bounded by the first kidney-like control opening.

7. The control plate of claim 6, wherein the second wall portion extends parallel with the rotation axis.

8. The control plate of claim 2, further comprising;

a second kidney-like control opening; and a second slot-like control opening, wherein the first and second kidney-like control openings and the first and second clot-like control openings are arranged symmetrically relative to a first plane of symmetry defined by the rotation axis and a vertex of a pitch circle located between the two first kidney-like control openings.

9. The control plate of claim 8, wherein the control plate is symmetrical relative to a second plane of symmetry defined by the rotation axis, and that is normal relative to the first plane of symmetry.

10. A control plate, the control plate configured to alternatingly connect hydrostatic operating chambers of an oblique axis construction type axial piston machine to pressure medium connections of the axial piston machine in terms of pressure medium, the control plate comprising:

a first end face extending transversely to a rotation axis, the first end face including:

a first kidney-like control opening; and a first recess bounded in the first end face by the first kidney-like control opening, the first recess having a first wall portion at an end portion of the first kidney-like control opening, the first wall portion arranged in or counter to a rotation direction around the rotation axis; and a second end face directed away from the first end face, wherein the first recess at least partially forms at least one through recess extending from the first end face toward the second end face, and the first wall portion has a curved end portion at a junction with the at least one through recess, wherein:

the first wall portion has cross-sections that are arranged in planes that are oriented normal to the rotation axis; and the cross-sections are circle portions with identical radii.

11. The control plate of claim 10, wherein the cross-sections have circle centers that form a constant curve.

12. The control plate of claim 10, wherein:

the second end face further includes a second recess associated with the first recess;

the second recess forms a first slot-like control opening in the second end face; and the at least one through recess is at least partially formed by the second recess so as to extend from the second end face in a direction toward the first end face.

13. The control plate of claim 12, wherein the second recess has, in a region of an end portion of the second slot-like control opening, a third wall portion arranged in a pivot direction, the third wall configured so as to be convex in a radial direction of a pivot axis of the control plate.

14. The control plate of claim 12, wherein the first recess and the second recess form an intersection.

15. The control plate of claim 14, wherein the intersection is configured, at least partially, so as to have a sharp edge portion.

16. A control plate, the control plate configured to alternatingly connect hydrostatic operating chambers of an oblique axis construction type axial piston machine to pressure medium connections of the axial piston machine in terms of pressure medium, the control plate comprising:

a first end face extending transversely to a rotation axis, the first end face including:

a first kidney-like control opening; and a first recess bounded in the first end face by the first kidney-like control opening, the first recess having a first wall portion at an end portion of the first kidney-like control opening, the first wall portion arranged in or counter to a rotation direction around the rotation axis; and a second end face directed away from the first end face, wherein the first recess at least partially forms at least one through recess extending from the first end face toward the second end face, and the first wall portion has a curved end portion at a junction with the at least one through recess, wherein:

the first wall portion has cross-sections that are arranged in planes that are oriented normal to the rotation axis; and the cross-sections are circle portions with different radii.

17. The control plate of claim 16, wherein:

the second end face further includes a second recess associated with the first recess;

the second recess forms a first slot-like control opening in the second end face; and the at least one through recess is at least partially formed by the second recess so as to extend from the second end face in a direction toward the first end face.

18. The control plate of claim 17, wherein the second recess has, in a region of an end portion of the second slot-like control opening, a third wall portion arranged in a pivot direction, the third wall configured so as to be convex in a radial direction of a pivot axis of the control plate.

19. The control plate of claim 17, wherein the first recess and the second recess form an intersection.

20. The control plate of claim 19, wherein the intersection is configured, at least partially, so as to have a sharp edge portion.

* * * * *